US006430264B1

(12) United States Patent
Lee

(10) Patent No.: US 6,430,264 B1
(45) Date of Patent: Aug. 6, 2002

(54) ROTARY ANODE FOR AN X-RAY TUBE AND METHOD OF MANUFACTURE THEREOF

(75) Inventor: David S. Lee, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/561,762

(22) Filed: Apr. 29, 2000

(51) Int. Cl.[7] ..... H01J 35/10
(52) U.S. Cl. ..... 378/144; 378/143
(58) Field of Search ..... 378/119, 126, 378/127, 143, 144; 428/408

(56) References Cited

U.S. PATENT DOCUMENTS 5,943,389 A * 8/1999 Lee ..... 378/144

* cited by examiner

*Primary Examiner*—Robert H. Kim
*Assistant Examiner*—Hoon K. Song
(74) *Attorney, Agent, or Firm*—Workman, Nydegger & Seeley

(57) ABSTRACT

The present invention is directed to an x-ray tube, and method of manufacture thereof, having an improved rotary anode target structure. The anode target is constructed of carbon-carbon composite material. A focal track is formed on the surface of the anode target, and is comprised of a metallic material that is capable of generating x-rays when contacted with a high velocity electron stream. The surface of the carbon-carbon composite anode is treated in a manner so as to provide an enhanced bond between the composite and the focal track material, and which diffuses any interfacial stresses that occur between the track layer and the composite substrate during thermal expansion of the two materials, which may differ significantly. In particular, the bond interface is formed by microscopically roughening the surface of the substrate, so as to provide a "saw-tooth"-like, or jagged, surface configuration. This provides a high surface contact area per unit length between the composite and the focal track material, thereby diffusing any stresses resulting from thermal expansion of the two materials. This jagged bond interface surface is formed by removing carbon atoms from the composite surface by way of an oxidization process, such as thermal etching. In addition, the surface of the composite may also be mechanically etched, such as laser etching, to further provide a roughened surface.

25 Claims, 4 Drawing Sheets

ROTARY ANODE FOR AN X-RAY TUBE AND METHOD OF MANUFACTURE THEREOF

FIELD OF THE INVENTION

The present invention relates generally to x-ray producing equipment. More particularly, the invention relates to an improved anode target structure present on an x-ray tube of the sort that is commonly used in such x-ray producing equipment. In addition, the present invention relates to a method of manufacturing an improved anode target structure for use in an x-ray tube.

BACKGROUND OF THE INVENTION

X-ray producing devices are extremely valuable tools that are used in a wide variety of applications, both industrial and medical. Such equipment is commonly used in areas such as diagnostic and therapeutic radiology; semiconductor manufacture and fabrication; and materials testing.

The basic operation for producing x-rays in the equipment used in these different industries and applications is very similar. X-rays, or x-radiation, are produced when electrons are produced and released, accelerated, and then stopped abruptly. Typically, this entire process takes place in a vacuum formed within an x-ray generating tube. An x-ray tube ordinarily includes three primary elements: a cathode, which is the source of electrons; an anode, which is axially spaced apart from the cathode and oriented so as to receive electrons emitted by the cathode; and some mechanism for applying a high voltage for driving the electrons from the cathode to the anode.

The three elements are usually positioned within an evacuated glass tube, and connected within an electrical circuit. The electrical circuit is connected so that the voltage generation element can apply a very high voltage (ranging from about ten thousand to in excess of hundreds of thousands of volts) between the anode (positive) and the cathode (negative). The high voltage differential causes a thin stream, or beam, of electrons to be emitted at a very high velocity from the cathode towards an x-ray "target" positioned on the anode. The x-ray target has a target surface (sometimes referred to as the focal track) that is comprised of a refractory metal. When the electrons strike the target, the kinetic energy of the striking electron beam is converted to electromagnetic waves of very high frequency, i.e., x-rays. The resulting x-rays emanate from the anode target, and are then collimated for penetration into an object, such as an area of a patient's body. As is well known, the x-rays that pass through the object can be detected and analyzed so as to be used in any one of a number of applications, such as x-ray medical diagnostic examination or material analysis procedures.

In general, a very small part of the electrical energy used for accelerating the electrons is converted into x-rays. The remainder of the energy is dissipated as a large amount of heat in the target region and the rest of the anode. This heat can damage the anode structure over time, and can negatively affect the operating life of the x-ray tube and/or the performance and operating efficiency of the tube. To alleviate this problem the x-ray target, or focal track, is typically positioned on an annular portion of a rotatable anode disk. The anode disk (also referred to as the rotary target or the rotary anode) is mounted on a supporting shaft that is rotated by a motor. The motor is used to rotate the disk at high speeds (often in the range of 10,000 RPM), thereby causing the focal track to rotate into and out of the path of the electron beam. In this way, the electron beam is in contact with specific points along the focal track for only short periods of time, thereby allowing the remaining portion of the track to cool during the time that it takes the portion to rotate back into the path of the electron beam.

While the rotation of the track helps reduce the amount and duration of heat dissipated in the anode target, the focal track is still exposed to very high temperatures—often temperatures of 2500° C. or higher are encountered at the focal spot of the electron beam. Thus the rotary anode must still be constructed of a material that is both resistant to heat, and that can effectively block an impinging high velocity electron beam. Moreover, since the disk is rotated at high rotational speeds, it must be capable of withstanding high mechanical stresses. One commonly used material for an anode disk is a refractory metal, such as a molybdenum alloy, an example of which is known as TZM (titanium-zirconium-molybdenum). Refractory metals are, however, expensive, and require complex manufacturing and processing procedures to be used for fabrication of an anode disk. Also, such metal alloys are quite dense and thus can be very heavy, which can be especially problematic when a larger anode disk is used. For instance, the higher weight requires a larger motor and stronger rotor assembly to rotate the anode disk, resulting in higher costs, and greater wear and tear on the components. Moreover, the increased weight of a metal anode disk makes it more difficult to rotate at high speeds, especially in x-ray devices that require the anode disk to be accelerated quickly to high operational speeds in short periods of time.

One approach to address the problems encountered when a refractory metal is used, has been to use a graphite material. Graphite offers several advantages over metal. It has a significantly higher heat storage capacity than metal, and thus can operate at higher temperatures for longer periods of time. Graphite also has a much lower density (lighter weight) than metal, so it can be more easily rotated at higher speeds, allows for the use of bigger targets, and puts less mechanical stress on the anode assembly (such as the rotor, bearings and motor).

Graphite, however, has a low mechanical strength and can be brittle, especially pressed and sintered graphite. As such, mechanical loading—for example, tangential loading during starting and stopping of rotation—can cause fracturing of the graphite disk, especially with the high rotational speeds encountered by the rotating anode. Also, a focal track constructed of a material that is capable of blocking an impinging high velocity electron beam must be applied directly to the graphite substrate. Typically, this results in an anode where the rate of heat transfer from the focal track to the substrate is slower than when a focal track is attached to a metal substrate, such as TZM. Under certain operating conditions, this can cause an overheating of the focal track and resultant damage to the graphite target disk, such as bonded layer failure.

It has also been proposed that a carbon-carbon composite material be used in place of graphite. Such a material exhibits the same heat storage capacity and low weight characteristics of graphite, but is much stronger than graphite, and is better able to withstand the mechanical stresses imposed. As with graphite, a suitable metal material must be bonded to the carbon-carbon disk to function as the anode focal track. The material must be of sufficient thickness so as to effectively block an impinging high velocity electron beam and generate usable x-ray output, and must also be capable of withstanding the high temperatures that are dissipated on the track during operation. At the same time, the focal track material must remain bonded to the underlying carbon-carbon composite disk. This gives rise to the primary problem with the carbon-carbon material, in that its thermal expansion rate differs significantly from the metal materials that are commonly used for the focal track on the disk. Maintaining a bond is thus difficult to achieve. When exposed to high temperatures, the different thermal expansion rates result in a macroscopic buildup of stresses across the bonding surface between the focal track target material and the carbon-carbon composite material. These stresses often result in a debonding, peel-off, or cracking of the target layer, which can render the x-ray tube inoperable, shorten its operating life, or reduce its operating efficiency.

As such, there is a need in the art to provide a rotating anode disk that is constructed of a material that has a low density and is a light weight. The disk should also have a high heat storage capacity and be capable of being used in extremely high heat conditions. In addition, the disk should be capable of withstanding the high mechanical stresses encountered at high rotational speeds. Moreover, it would be desirable to have a disk structure that can be used in connection with a refractory metal target surface that is capable of stopping an impinging high velocity electron beam so as to produce x-rays in an efficient manner. Finally, the bond between the refractory metal target surface and the underlying disk substrate material should be capable of withstanding the stresses that result from the different rates of thermal expansions of the two materials when they are together subjected to high temperature conditions.

SUMMARY OF THE INVENTION

It is, therefore, a primary object of the present invention to provide an improved rotating anode for use in connection with an x-ray tube and x-ray generating system.

It is another object of the present invention to provide a rotating anode that is constructed of a substrate material that has a low density and that is light in weight.

It is still another object of the present invention to provide a rotating anode that is constructed of a substrate material that is durable and resistant to cracking or other catastrophic failure, even when subjected to extremely high rotational speeds.

It is yet another object of the present invention to provide a rotating anode that is capable of being subjected to the high thermal stresses that are present in an operating x-ray tube.

It is an even further object of the present invention to provide a rotating anode that utilizes a focal track that can be thermally and mechanically bonded to a carbon-carbon composite substrate material and that remains attached even when exposed to high operational temperatures.

Yet another object of the present invention is to provide a method for manufacturing a rotating anode that achieves the foregoing objectives.

In accordance with the invention as embodied and broadly described herein, the foregoing and other objectives are achieved by the present invention, which is directed to an improved rotary anode for use within an X-ray tube of the sort that is commonly used in x-ray producing systems. Further, the invention is directed to a novel method for manufacturing the improved rotary anode. In general, the present invention is directed to an improved rotary anode that is constructed of a carbon composite material, which in a presently preferred embodiment is a carbon-carbon composite material. This composite is particularly suitable for use as a rotating anode material. The material has a low density, and thus is very light in weight. This permits the construction of a rotating anode that is also light in weight, even when built in larger dimensions. As such, the anode can be more easily rotated and accelerated to the high operational speeds that are common in many x-ray systems and applications. Also, the lighter weight characteristics mean that the operational speeds can be obtained without requiring a larger motor, and without requiring a stronger rotor and bearing assembly. This reduces the overall cost of the x-ray tube system. Moreover, the material is extremely strong and durable, and remains so in the presence of extremely high temperatures. Further, the material dissipates heat efficiently, and thus allows a rotating anode to remain sufficiently cool during extended periods of operation.

In addition, the improved anode includes a focal track which is comprised of conventional metallic materials that are capable of efficiently generating x-rays when contacted with a high speed electron stream. In the anode of the present invention, such focal track materials are capable of being thermally and mechanically coupled to the carbon composite disk substrate, even though they exhibit rates of thermal expansion that are different from that of the underlying carbon substrate. This capability is provided by way of an interface means, that is disposed between the surface of the carbon anode disk and the target track material, that functions so as to diffuse interfacial stresses that occur between the track layer and the carbon composite substrate during thermal expansion of the two materials. Because these stresses are diffused, the track layer remains bonded to the carbon substrate, even when exposed to the extremely high temperatures present during the operation of an x-ray tube.

In one presently preferred embodiment, the interface means is comprised of a bond interface layer that is formed on the top surface of the carbon composite substrate material. More particularly, this interface layer is produced by microscopically roughening the surface of the substrate in a manner such that it structurally exhibits, for instance, as series of peaks and valleys similar to a "saw-tooth"-like configuration. This provides a high surface contact area per unit length, and diffuses any shear stresses that occur between the track layer and the composite substrate during thermal expansion and/or contraction.

In a preferred embodiment, the bond interface is formed on the surface of the carbon composite by removing carbon atoms from the surface. This removal of carbon atoms produces the above-mentioned "saw-tooth"-like arrangement. While removal of carbon atoms can be accomplished using various techniques, in a preferred embodiment it is accomplished by thermally etching (oxidizing) the surface of the carbon-carbon composite substrate. The carbon composite is comprised of both carbon fibers and carbon matrix, and the oxidation process removes carbon atoms from the fibers and the matrix at different rates, thereby producing the roughened surface.

In addition to providing an improved bond interface, the saw tooth arrangement also provides additional benefits. In particular, the composite material possesses improved thermal emissivity characteristics. This allows the rotating anode to cool down more efficiently, thereby permitting it to be operated at higher temperatures for longer periods of time.

Additional objects, features and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
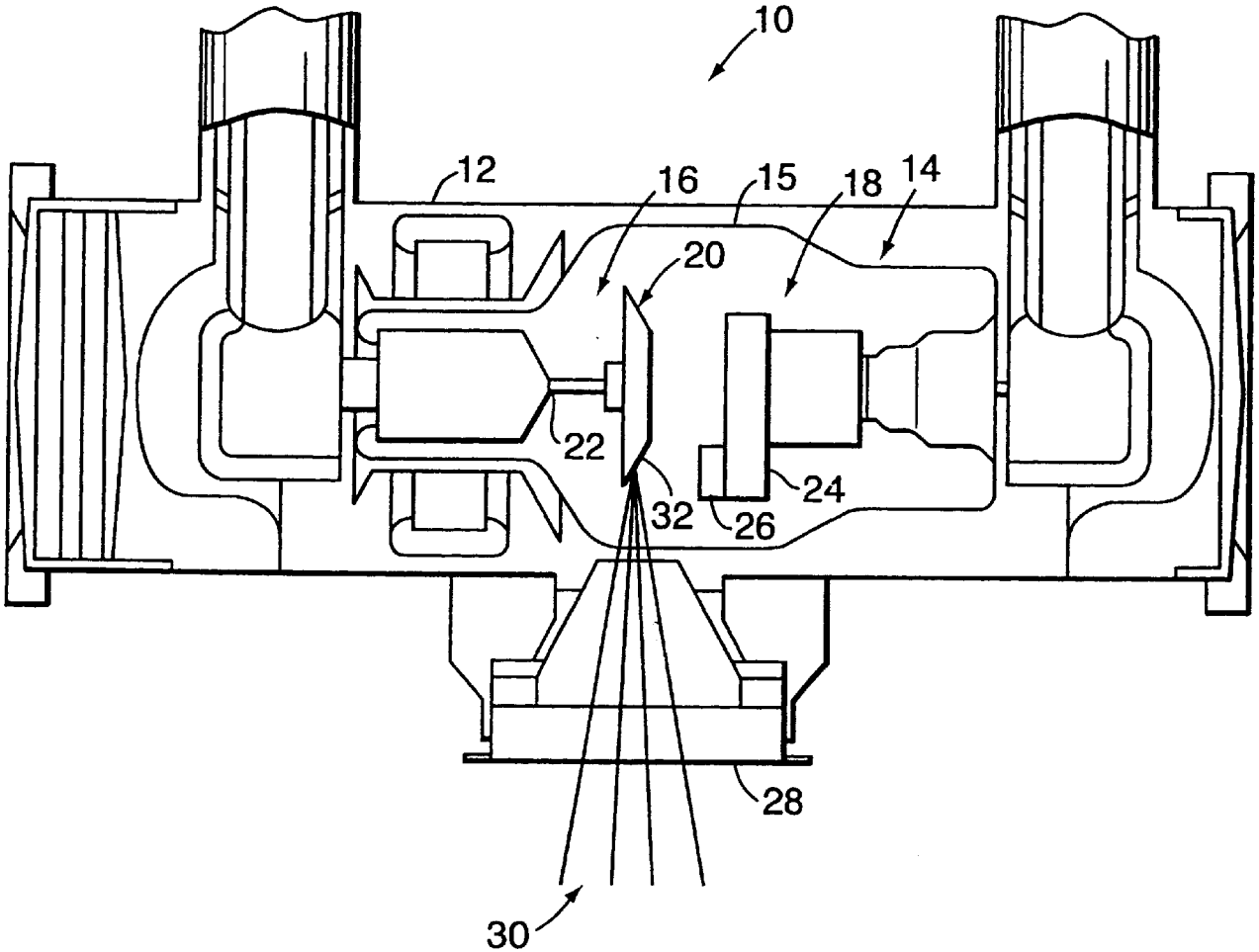
FIG. 1 (PRIOR ART)
FIG. 1 is a side view illustrating a typical x-ray system and x-ray tube in which the present invention finds particular application.

Reference is now to the drawings, in which reference numerals are used to designate parts throughout the various figures. FIG. 1 illustrates an example of the sort of radiographic system that would typically utilize the type of rotating anode x-ray tube in which the current invention finds particular application. It will be appreciated that while example embodiments of the invention are described in connection with the system illustrated in FIG. 1, the invention could also be used in connection with other similar devices that use rotating anode x-ray tubes.

The x-ray system of FIG. 1, designated generally at 10, is enclosed within a metal casing 12. As noted in the background section above, the x-ray system 10 includes an x-ray tube, designated at 14, which is composed of a glass or metal envelope 15 that encloses an anode section 16 and a cathode section 18 within a vacuum. The anode section 16 includes a rotating anode target 20, which is attached to a rotor 22 for rotation by a motor, or similar driving mechanism. The cathode section 18 includes a cathode plate 24 and a cathode filament 26, which are axially spaced apart from the anode target 20. A window 28 is formed in the casing 12, and is positioned relative to the rotating anode target 20 so that any x-rays that are produced by the x-ray tube can exit through the window 28.

In operation, an electrical voltage potential is generated between the anode section 16 and the cathode section 18 so that an electron stream is emitted from the cathode filament 26 and directed towards a target surface 32 that is formed on the outer periphery on the rotating target 20. As the electron stream strikes the target surface 32 of the rotating target 20, x-rays are produced, shown at lines 30, and are emitted from the surface of the target 32 out through the window 28. The rotating anode target 20 is connected to the rotor 22 by conventional mechanisms so that the target surface track 32 continuously rotates under the focused electron beam. It will be appreciated by one of skill in the art that an x-ray system of the sort illustrated in FIG. I includes additional parts and operational features which don't require further elaboration here.

As already noted, the components of the x-ray system 10 are subjected to various mechanical and thermal stresses. Especially problematic are the extremely high temperatures that can occur in the various sections of the x-ray system during its operation, which are produced as a by-product of the energy released when the electrons strike the target surface 32. In fact, temperatures at the focal spot of the target surface 32 can reach temperatures in excess of 2500° C. In addition, the cycle of rapid acceleration of the rotating target 20 (often up to speeds in excess of 10,000 RPM) and immediate breaking of the rotation also creates mechanical stress on the target structure 20 and on the rotor 22 assembly, which are exacerbated by the high temperatures. These extreme temperatures and mechanical stresses can lead to failures in the x-ray tube, including the anode target, thereby reducing the overall life and/or operational effectiveness of the x-ray tube and system. This problem is addressed by the present invention, which is directed to a novel anode target structure that is low in weight, strong, and able to operate under high temperatures.

Figure 2:
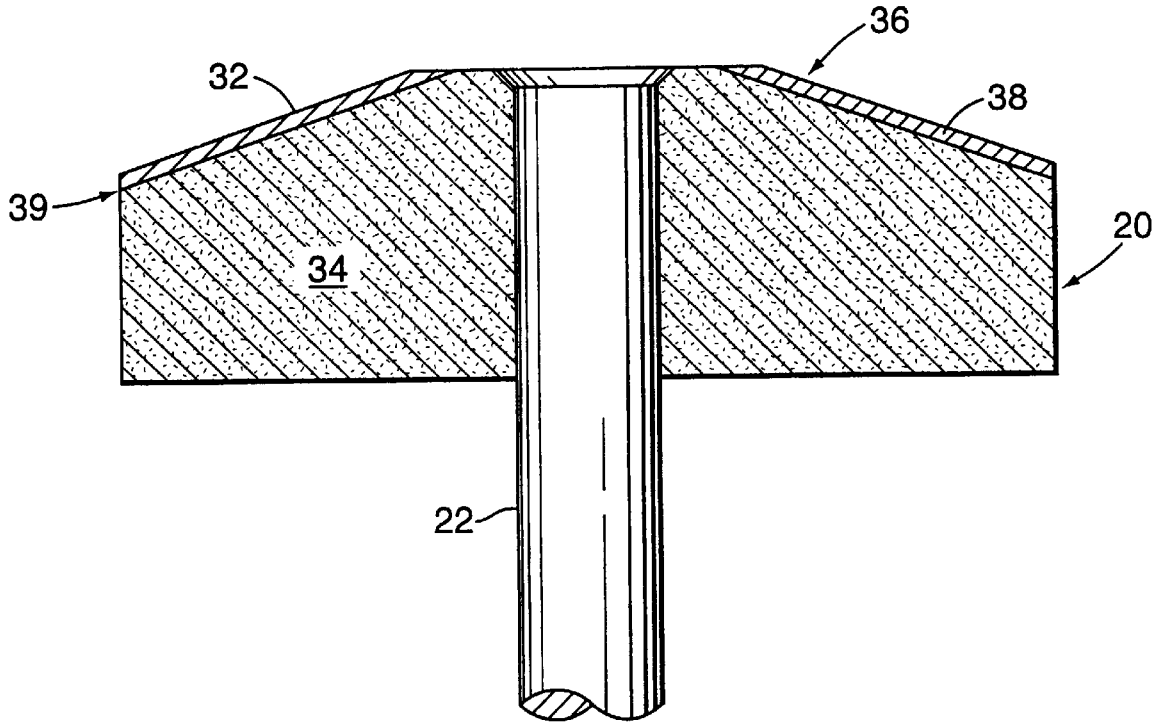
FIG. 2 is a sectional view of an embodiment of the target anode assembly of the present invention.

Reference is next made to FIG. 2, which depicts a cross-sectional view of a representative rotating anode target 20 according to one embodiment of the present invention. The rotating target 20 is formed as a circular disk. A rotor 22 that can be used to rotate the disk by way of an electrical motor, or similar driving mechanism, is affixed to the center of the target 20 through an axial bore. In the illustrated embodiment, the disk shaped anode target 20 is comprised of a main body portion 34. The outer periphery of the top surface 36 of the target 20 is tapered at a slight angle. Positioned along this outer periphery is the focal track 32, which is comprised of a metal layer 38 of sufficient composition and thickness so as to be capable of blocking an electron stream and generating an x-ray output. Examples of suitable focal track materials are described below.

The main body portion of the disk 34 is preferably comprised of a carbon-carbon (C—C) composite substrate material. This composite material is comprised of carbon fibers that are arranged in a geometrically woven, or randomly arranged pattern. Impregnated within the fibers is a carbon matrix material. This type of composite material exhibits a number of characteristics that make it especially suitable for use as a substrate in the construction of a rotating anode. First, the arrangement of the carbon fibers and the carbon matrix results in a composite material that has a very high modulus of elasticity. Thus, unlike pure graphite, an anode disk constructed of this type of composite is extremely strong and durable, and is able to withstand the mechanical stresses associated with the high rotational speeds of the rotating anode. Moreover, the composite material is able to withstand the high temperatures encountered in the x-ray system. In addition, the composite material has a low density, and therefore provides the ability to construct a rotating anode that is low in weight. The lighter weight is advantageous because the anode can be larger in size, and can be accelerated to high rotational speeds, without requiring larger motors and/or bearings and rotating shafts. Yet another important advantage provided by the carbon-carbon composite material is its ability to resist and/or arrest the propagation of any cracks that do happen to form in the material. This is due to the physical make-up of the composite elements. More particularly, there are gaps, or spaces, interspersed within the carbon fiber/carbon matrix elements. Thus, if a crack forms within the anode disk, the leading edge of the crack will only advance, or propagate, through the material until it encounters one of these gaps or spaces. Upon reaching a gap/space, the crack is essentially arrested and diffused. Because these gaps/air spaces are distributed uniformly throughout the composite material, the formation/propagation of a crack is typically diffused before it can become large enough to cause serious damage, or result in the catastrophic failure of the anode target when it is subjected to the types of stresses encountered at high rotational speeds.

In one presently preferred embodiment, a carbon-carbon substrate material such as Aerolor-35™, commercially available from CARBONE LORRAINE, Cedex, France, is used. This particular type of carbon-carbon composite is fabricated by a chemical vapor deposition (CVD) process, which impregnates the carbon fibers with the carbon matrix. It will be appreciated that other types of carbon-carbon composites can be used, including those that are fabricated using techniques other than a CVD process, such as processes wherein the carbon matrix material is infiltrated by force, or a combination of both processes.

As is illustrated in FIG. 2, formed along at least a portion of the top surface of the rotating anode 20 is the focal track 32. As already noted, the focal track 32 is comprised of a layer of a high impedance material that is capable of producing a high x-ray output when it is impinged with a high velocity electron stream, and that is also stable at high voltages. It will be appreciated by one of skill in the art that any one of a number of high impedance metals, or metal alloys could be used for the focal track layer. However, it has been found that several metal alloys are particularly efficient in the present environment.

In one preferred embodiment, the focal track 32 is prepared using a tantalum (Ta) surface coating, which is applied with conventional physical or chemical vapor deposition techniques. When heated during the application process, the material converts to tantalum carbide (TaC). Preferably, a minimum coating thickness of 5–10 microns is used so as to provide a surface that is able to generate a usable x-ray output, with 8–10 microns being a most preferred range. It is anticipated, however, that the thickness could be increased, and still provide a sufficient x-ray generation characteristic. However, a smaller thickness is preferred so as to reduce the formation of cracks in the focal track arising from a significant difference in thermal expansion during the manufacturing process.

In another preferred embodiment, a tungsten-rhenium (W/Re) alloy (e.g., 3 to 7% rhenium in tungsten by weight) is used for the track layer 32. In this embodiment, the track is formed by first applying a 1–2 micron tantalum layer, and then a 30 micron thick rhenium carbon diffusion barrier, followed by a 0.010" thick tungsten-rhenium alloy layer (e.g., 3 to 5% rhenium in tungsten by weight). Again, it is anticipated that various combinations of layers and layer thicknesses could also be used.

In addition to the above materials, other metals and metal alloys could be used in connection with the present invention. For instance, in addition to tantalum and tungsten, other strong carbide forming metals, such as hafnium (Hf), zirconium (Zr), niobium (Nb), titanium (Ti), vanadium (V), etc., could be used. These types of materials can be deposited in combination with other metallic elements so as to achieve a track layer that exhibits good x-ray producing properties, as well as strong bonding characteristics with the underlying composite, which is described in further detail below.

As noted in the background section, the above types of metals and metal alloys that are used for the track coating have thermal expansion rates that differ significantly from that of the carbon-carbon composite substrate material. For instance, a presently preferred carbon-carbon composite material exhibits a thermal expansion rate of approximately 2 to $3\times10^{-6}$ inch/inch/C.°. On the other hand, tungsten or tungsten-rhenium based alloys have an expansion rate of approximately 4 to $5\times10^{-6}$ inch/inch/C.°. As such, absent the teachings of the present invention, problems are encountered when the metallic track layer and the underlying carbon-carbon composite material are exposed to high temperatures, either during the manufacturing process or during operation of the x-ray tube. In particular, the disparate rates of expansion cause an interfacial stress between the two materials, which can delaminate the focal track layer from the surface of the composite. Of course, this leaves a surface that is incapable of effectively impinging the high velocity electron beam, and can render the x-ray tube useless.

Figure 3:
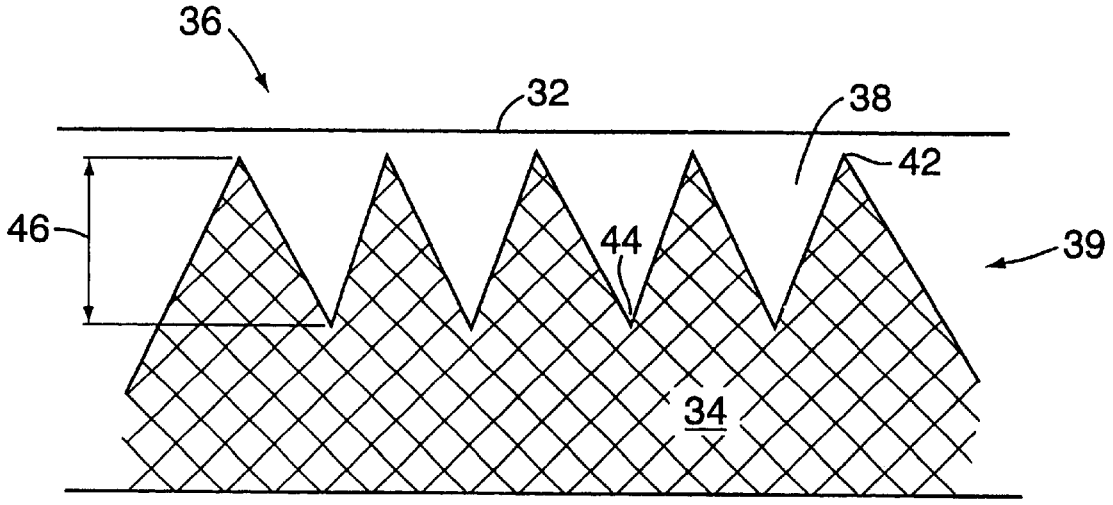
FIG. 3 is an illustration showing an example of the general structure of the bond interface between the target track material and the carbon-carbon composite material of the target anode.

The problems resulting from the thermal mismatch between the metallic focal track layer and the C—C composite substrate are addressed by providing a unique bond interface, designated at 39 in FIG. 2, between the focal track layer and the adjacent carbon-carbon composite substrate. In general, this bond interface is implemented by modifying the surface of the carbon-carbon composite substrate before the focal track layer material 38 is applied. In a presently preferred embodiment, this modification is accomplished by roughening the composite surface so as to produce a "saw-tooth"-like configuration. An example of this preferred configuration is shown in FIG. 3, which illustrates how the composite 34 has a series of peaks 42 and valleys 44 along the interface surface with the track layer. Such a configuration provides a high surface contact area per unit length along the buffer zone 39, which functions to diffuse shear stresses that occur between the track layer and the composite substrate during thermal expansion/contraction.

Figure 4:
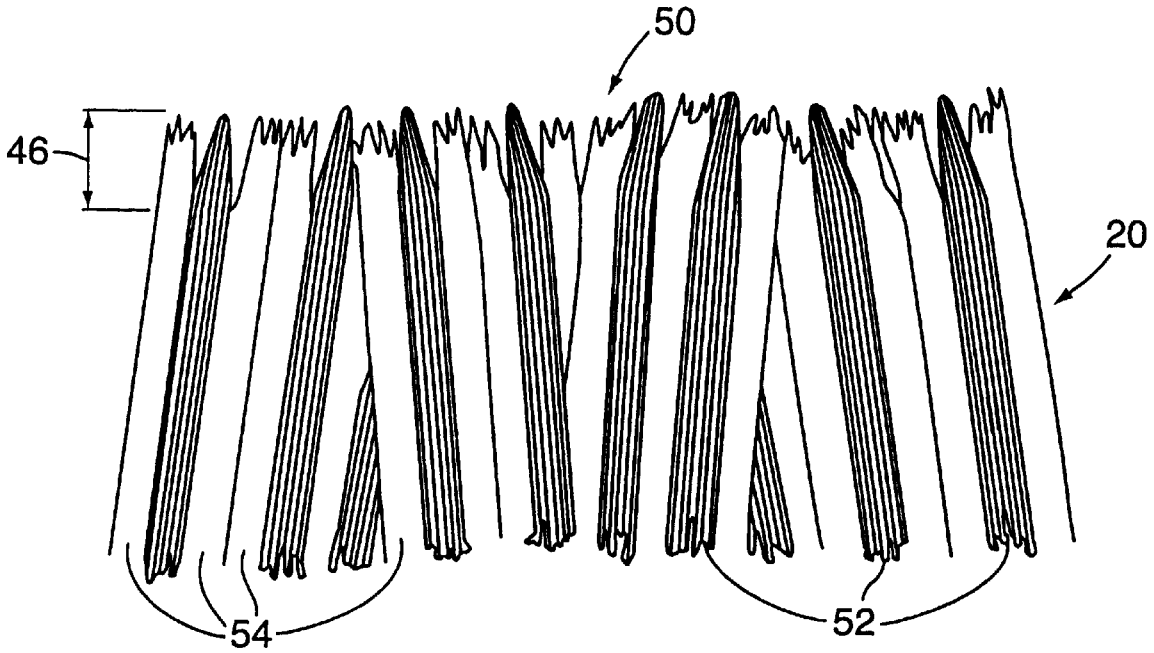
FIG. 4 shows in further detail the fiber structure of the carbon-carbon composite material of the bond interface with the target anode.

In one preferred embodiment, the "saw-tooth"-like configuration is produced by removing carbon atoms from the carbon fibers, and carbon atoms from the carbon matrix, at different respective rates. A preferred approach for removing atoms is to oxidize the surface of the composite material, by thermally etching the surface by exposing it to an oxygen-hydrogen torch. Other various gasses could also be used to thermally etch (oxidize) the composite surface. The difference in the rate of oxidation (and resultant carbon atom removal) is due to the difference in the crystalline structure of carbon atoms in the carbon fibers, and the carbon atoms in the CVD carbon matrix structure. FIG. 4 is representative of the surface morphology of the oxidized, or similarly etched, composite surface 50. Essentially, the core of the carbon fibers 52 change from a machined, flat-ended shape, to a more tapered, sharp end at the oxidized composite surface. In addition, the morphology of the surrounding CVD carbon matrix 54 also changes to a more jagged structure. As a result, the resultant surface morphology is in-situ carbon fibers 52 and carbon matrices 54 that form peaks and valleys in the otherwise flat composite surface, as is designated at the affected etch zone 46. Again, the new surface morphology provides a larger surface area for bonding to the track coating material, resulting in an interface that significantly reduces any stress induced by any thermal expansion mismatch between the track layer and the carbon-carbon composite substrate.

To achieve an effective bonding interface, the selective oxidation, or similar carbon atom removal process, should provide a rough surface of peak-to-valley distance ranging from approximately 0.001" to approximately 0.002" (the corresponding dimension is designated at 46 in FIG. 3). Utilizing the oxygen-hydrogen torch, it was found that a suitable surface roughness was obtained by heating the surface to over 900–1000° C., for 8–10 minutes in air.

It will be appreciated that although one preferred process is to utilize thermal etching with an oxygen-hydrogen torch, any one of a number of alternative processes that selectively remove carbon atoms from the composite surface, chemical or physical, could also be used to achieve the same result. For instance, plasma etching, or chemical etching, using chlorine, fluorine, or hydrogen could all be used to alter the surface morphology of the carbon-carbon anode disk.

Figure 5A:
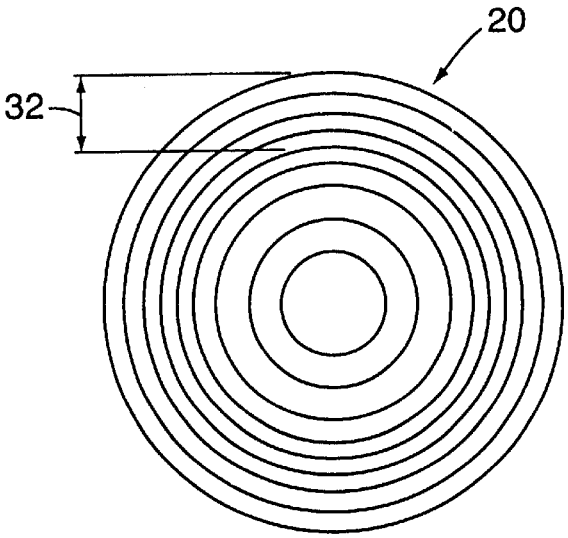
FIGS. 5A–5C show examples of preferred machined patterns for mechanical surface preparation of the carbon-carbon composite material in the target anode.
Figure 5B:
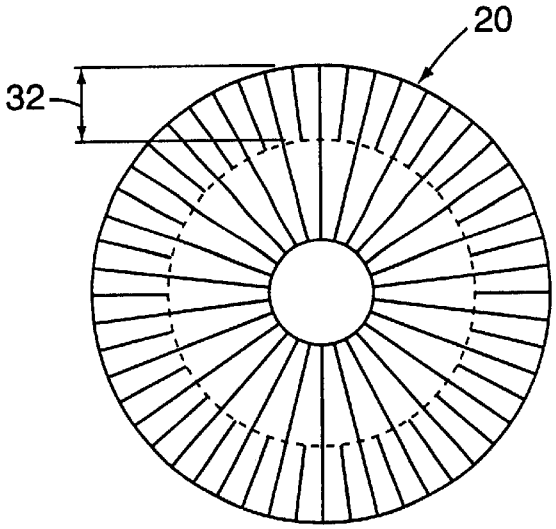
Figure 5C:
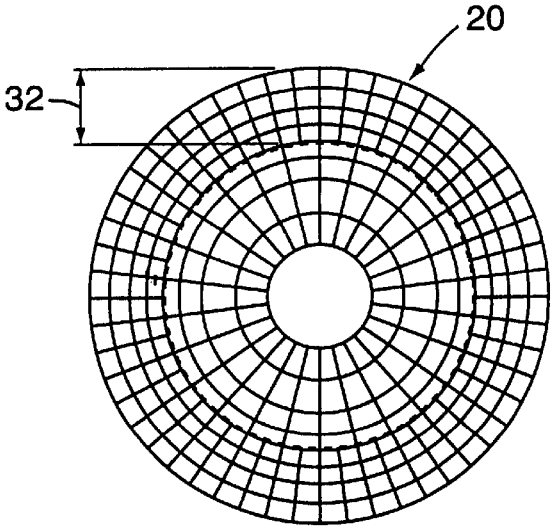

In addition to the alteration of the composite's surface morphology on a microscopic scale, in another preferred embodiment the composite surface can be machine grooved, or otherwise mechanically altered, so as to provide even further surface modification for improved track layer bonding. For instance, prior to the treatment of the surface of the carbon-carbon substrate in the manners described above, the surface can be prepared in several different patterns, some of which are shown in FIG. 5A (concentric groove pattern), 5B (sunburst groove pattern) or 5C (combination of concentric grooves/sunburst patterns). Surface modifications of this sort would preferably be done prior to the carbon atom removal process discussed above, and can be accomplished in several different ways. For instance, the surface arrangements can be provided by way of various etching processes such as laser etching, or various types of well known mechanical etching techniques.

While a primary advantage provided by the altered surface morphology of the carbon-carbon composite disk substrate is to provide an improved bond interface between the substrate and the focal track material, the alteration provides additional benefits as well. As already noted, the thermal dissipation capabilities of the substrate material when used in the construction of a rotary anode are extremely important, and is a critical characteristic that otherwise limits the maximum power that may be applied to the anode target. Typically, an anode x-ray target must be allowed to cool down when a certain maximum operating temperature is reached (e.g., 1050–1200° C. bulk anode temperature). If that temperature is exceeded, the anode structure, including the target, can be damaged, or its operating life reduced. This problem is addressed by the altered surface morphology of the carbon-carbon composite disk substrate described above. In particular, the surface morphology increases the thermal emissivity of the composite substrate by 20% or more. This increase in thermal emissivity over the entire anode surface results in an at least 10% to 20% improvement in cooling by radiation of the anode when compared to an anode constructed of a graphite substrate material.

In summary, the present invention addresses a number of problems in the prior art. In particular, an improved rotating anode for use in connection with X-ray producing equipment. The rotating anode is constructed of a carbon-carbon composite material that is light weight, extremely strong, and that is capable of withstanding extremely high temperatures. In addition, the surface of the carbon-carbon substrate material can be sufficiently altered so as to provide a bond interface that permits a wide variety of metallic target track materials to be used, and which, despite disparate thermal expansion characteristics, remain bonded to the substrate when exposed to high temperatures. Moreover, the surface morphology that provides the improved bond interface, also results in a composite anode material that exhibits improved thermal dissipation characteristics.

The present invention may be embodied in other specific forms without departing from its spirit or its essential characteristics. Thus, the desired embodiments are to be considered in all respects as illustrative only and not restrictive. The particular scope of the invention is indicated by the appended claims rather than by the foregoing description. All changes that come within the meaning and range of equivalency of the claims are to be embraced within their scope.

What is claimed is:

1. An X-ray tube anode target comprising:

a main body portion comprising a carbon based composite material;

a bond interface layer positioned on at least a portion of a top surface of the main body portion, the bond interface layer having a surface morphology comprising a plurality of substantially tapered ends that extend outwardly from the top surface; and an x-ray generating metallic layer formed on at least a portion of the bond interface layer.

2. An X-ray tube anode target as defined in claim 1, wherein the main body portion is comprised of a carbon-carbon composite material having carbon fiber and carbon matrix components.

3. An X-ray tube anode target as defined in claim 1, wherein the x-ray generating metallic layer includes at least one of tantalum, tungsten, rhenium, hafnium, zirconium, niobium, titanium, vanadium and alloys thereof.

4. An X-ray tube anode target as defined in claim 1, wherein the surface morphology of the bond interface layer is formed by removing carbon atoms from the top surface of the main body portion of the anode target.

5. An X-ray tube anode target as defined in claim 4, wherein the carbon atoms are removed by oxidizing the top surface of the main body portion of the anode target.

6. An X-ray tube comprising:

an envelope having an evacuated interior region;

a cathode disposed within the interior region; and an anode disposed within the interior region, the anode comprising:

a rotatable disk that is comprised of a carbon-carbon composite material;

a bond interface formed on a top surface portion of the rotatable disk, the bond interface having a jagged configuration defined by a plurality of substantially tapered peaks formed within the carbon-carbon composite material; and an annular target track layer that is mechanically and thermally coupled to the top surface of the rotatable disk adjacent to the bond interface so as to be impacted by electrons emanating from the cathode to generate x-rays.

7. An X-ray tube as defined in claim 6, wherein the carbon-carbon composite material includes carbon fibers intermixed with a carbon matrix.

8. An X-ray tube as defined in claim 7, wherein the bond interface layer is formed by removing carbon atoms from the carbon fibers, and carbon atoms from the carbon matrix, at different respective rates.

9. An X-ray tube as defined in claim 8, wherein the carbon atoms are removed at different respective rates by oxidizing the top surface of the rotatable disk.

10. An X-ray tube as defined in claim 9, wherein the top surface of the rotatable disk is oxidized by thermally etching the surface at a predetermined temperature for a predetermined duration of time.

11. An X-ray tube as defined in claim 6, wherein the target track layer comprises at least one of tantalum, tungsten, rhenium, hafnium, zirconium, niobium, titanium, vanadium and alloys thereof.

12. An X-ray tube as defined in claim 6, wherein the top surface of the rotatable disk is etched with a predefined pattern.

13. An X-ray tube anode target comprising:

a rotatable disk that is comprised of a carbon-carbon composite material;

an annular target track layer that is mechanically and thermally coupled to a top surface of the rotatable disk, the track layer comprised of an x-ray generating metallic material; and interface means, disposed between the top surface of the rotatable disk and the annular target track layer, for diffusing shear stresses that occur between the track layer and the carbon-carbon composite material of the rotatable disk during thermal expansion of the track layer and the composite material.

14. An x-ray tube anode target as defined in claim 13, wherein the interface means comprises an interface layer formed on the top surface of the rotatable disk and wherein the interface layer is roughened so as to exhibit a saw-tooth-like physical configuration.

15. An X-ray tube anode target as defined in claim 14, wherein the carbon-carbon composite material includes carbon fibers intermixed with a carbon matrix.

16. An X-ray tube anode target as defined in claim 15, wherein the interface layer is formed by removing carbon atoms from the carbon fibers, and carbon atoms from the carbon matrix, at different respective rates.

17. An X-ray tube anode target as defined in claim 16, wherein the carbon atoms are removed at different respective rates by oxidizing the top surface of the rotatable disk.

18. An X-ray tube anode target as defined in claim 17, wherein the top surface of the rotatable disk is oxidized by thermally etching the surface at a predetermined temperature for a predetermined duration of time.

19. An X-ray tube anode target as defined in claim 18, wherein the annular target track layer comprises at least one of tantalum, tungsten, rhenium, hafnium, zirconium, niobium, titanium, vanadium and alloys thereof.

20. An X-ray tube anode target as defined in claim 19, wherein the interface means further comprises an etched configuration on the surface of the rotatable disk, wherein the etched configuration has a predefined pattern.

21. A method of forming an anode target for an x-ray tube, the method comprising:

forming a main target portion comprised of a carbon-carbon composite substrate having a top surface;

forming a bond interface on the main target portion by removing carbon atoms from the top surface of the carbon-carbon composite substrate; and depositing an annular target track on at least a portion of the bond interface, wherein the annular target track comprises an x-ray generating metallic material.

22. The method of claim 21, wherein the carbon atoms are removed from the top surface of the carbon-carbon composite substrate by at least one of oxidization, plasma etching, and chemical etching.

23. The method of claim 21, further comprising the step of mechanically altering the top surface at the carbon-carbon composite substrate.

24. The method of claim 23, wherein the step of mechanically altering comprises etching a predetermined pattern into the top surface of the carbon-carbon composite substrate.

25. The method of claim 21, wherein the step of forming a bond interface is performed in a manner such that a top layer of the surface exhibits a saw-tooth-like physical configuration.

* * * * *

UNITED STATES PATENT AND TRADEMARK OFFICE

CERTIFICATE OF CORRECTION

PATENT NO. : 6,430,264 B2
APPLICATION NO. : 09/561762
DATED : August 6, 2002
INVENTOR(S) : Lee It is certified that error appears in the above-identified patent and that said Letters Patent is hereby corrected as shown below:

Col. 3
Line 15: After "is" delete "a"

Col. 4
Line 35: Change "as" to --a--

Col. 5
Line 38: After "now" insert --made--

Signed and Sealed this

Thirtieth Day of November, 2010

David J. Kappos

David J. Kappos
*Director of the United States Patent and Trademark Office*